United States Patent [19]

Hickey

[11] Patent Number: 4,566,367

[45] Date of Patent: Jan. 28, 1986

[54] UNDERWATER WEAPON SYSTEMS

[75] Inventor: Christopher D. D. Hickey, Haywards Heath, United Kingdom

[73] Assignee: Underwater Storage Limited, Sussex, United Kingdom

[21] Appl. No.: 559,275

[22] Filed: Dec. 8, 1983

[30] Foreign Application Priority Data

Dec. 10, 1982 [GB] United Kingdom ..... 8235284

[51] Int. Cl.[4] ..... F42B 22/00; F41F 3/08; F41F 3/10

[52] U.S. Cl. ..... 89/1.810; 102/411

[58] Field of Search ..... 102/411, 412, 406; 89/1.810, 1.809

[56] References Cited

U.S. PATENT DOCUMENTS

| | | | |
|---|---|---|---|
| 2,818,807 | 1/1958 | Tracey | 102/411 |
| 3,072,022 | 1/1963 | Wood et al. | 89/1.810 X |
| 3,137,203 | 6/1964 | Brown | 89/1.810 |
| 3,158,062 | 11/1964 | Feiler | 89/1.810 |
| 3,279,319 | 10/1966 | Semonian et al. | 89/1.810 |
| 3,301,132 | 1/1967 | Lehmann et al. | 89/1.810 |
| 3,499,364 | 3/1970 | D'Ooge | 89/1.810 |
| 4,003,291 | 1/1977 | Vass et al. | 89/1.810 |
| 4,274,333 | 6/1981 | Lampton | 102/411 X |
| 4,395,952 | 8/1983 | Hickey | 89/1.810 X |

*Primary Examiner*—David H. Brown
*Attorney, Agent, or Firm*—Young & Thompson

[57] ABSTRACT

An underwater weapon system comprises an elongate outer container which is positioned horizontally on the sea bed and which has powered screws or scroll devices extending along its underside to displace sand or silt and so bury or partially bury the container in the sea bed. The weapon is self-propelled and is activated after raising and ejecting or partially ejecting an inner container to lift the weapon.

14 Claims, 2 Drawing Figures

UNDERWATER WEAPON SYSTEMS

BACKGROUND OF THE INVENTION

1. Field of the Invention

This invention relates to underwater weapon systems.

2. Prior Art

As is described in U.S. Pat. Spec. No. 4,395,952, an underwater weapon system may comprise a container adapted for burying or partially burying in a sea bed and a self-propelled weapon which is released from the container when required for use. In the afore-mentioned specification, the burying of the container is effected by means of a fluid pump for displacing sand or silt on the sea bed.

SUMMARY OF THE INVENTION

The present invention is concerned more particularly with improvements to such a weapon system, more particularly to effecting burial or partial burial of the container in a sea bed of harder material, for example shingle or impacted silt.

Self-propelled weapons such as might be used underwater are generally of elongate form and hence the container would conveniently also be of elongate form. If the device is lowered or dropped vertically on to the sea bed and buried or partially buried whilst upright, a deep excavation is necessary if they are not to protrude for any signficant distance above the sea bed. The depth of burial is very much less if they can be buried horizontally and the present invention is directed to an improved construction for this purpose.

According to the present invention, an underwater weapon system comprises a self-propelled weapon, an elongate container for the weapon, ejection means for expelling the weapon from the container and material displacing means disposed along the length of the container to form the lower part of the system when the container is disposed horizontally, said material displacing means being arranged for cutting into and displacing material on the sea bed underneath the container.

The material displacing means conveniently comprises rotary material displacing means, e.g. one or more rotary screw devices or scrolls.

With this construction, it is possible to position the container horizontally on the sea bed; in this case the depth of burial can be made very much less than with vertical burial. It will be appreciated that burial need be only just sufficient to avoid a significant and detectable protrusion from the surface of the sea bed. With a container laid horizontally, the rotary material displacing means may comprise one or more screw devices extending along the underside of the container and rotatable to displace material on the sea bed from underneath the container. Conveniently two such screw devices are employed arranged parallel to one another and preferably rotating in opposite direction so as to tend to displace the material outwardly to opposite sides of the container. With a pair of such contrary rotating screw devices, the two screws may be arranged to intermesh. In this case, they may be rotated in directions such that the intermeshing parts move downwardly and then outwardly sideways to force material from the sea bed up towards and beyond the sides of the container. With an underwater weapon system of this kind, pump means or water jet means may be provided additionally for displacing fine particulate material such as sand or silt. The pump may give a water jet or jets for forcing material outwardly away from the region under the container or may pump the material upwardly, e.g. through a duct or ducts in the container to a discharge outlet.

Preferably, the weapon is housed within or partially within an inner container inside said elongate container and the aforementioned ejection means is arranged to operate on the inner container to expel or partially expel it from the elongate container. By this means, the inner container with the weapon inside it can be raised so as to be above or partially above the sea bed before the weapon is ejected from the inner container. The weapon is thus free to move under its own propulsion system after the inner container is opened. Auxiliary ejection means (e.g. in the form of a pressurized gas supply) may however be provided for ejecting the weapon from the inner container. To move the inner container out or partially out of the outer container, conveniently hydrostatic pressure is employed, e.g. using a pump. For example, the outer container and the inner container may be of generally cylindrical form and the inner container may be moved outwardly by hydraulic pressure on one end, after the outer container, at the other end, has been opened, the inner container acting in a manner similar to a piston in a cylinder. The rotary material displacing means for burying the container conveniently are electrically operated using a battery powered electric motor or motors.

The weapon may have a guidance means, e.g. target sensing means, which may be arranged to detect a target and to guide the weapon onto the target. The same or separate target sensing means may be utilised for actuating mechanism in the container for releasing the weapon. Alternatively, or additionally, external control means responsive to a signal or signals from a distant control station, e.g. radio or acoustic signals, may be provided for actuating the release mechanism for the weapon system.

DESCRIPTION OF THE PREFERRED EMBODIMENT

Figure 1:
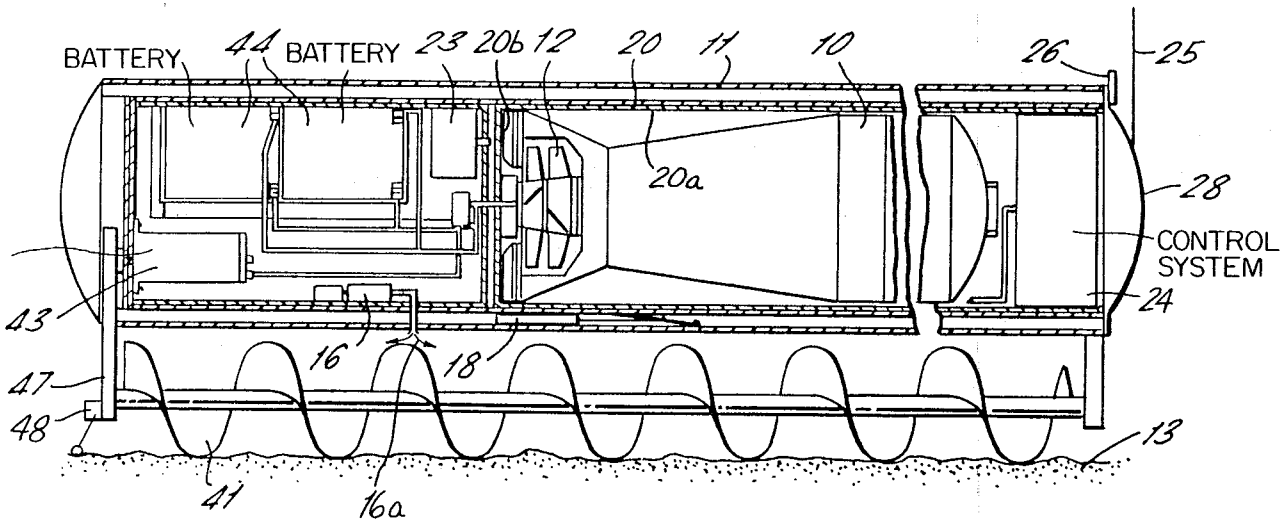
FIGS. 1 and 2 are respectively diagrammatic side and end elevations of a weapon system for burying horizontally.
Figure 2:
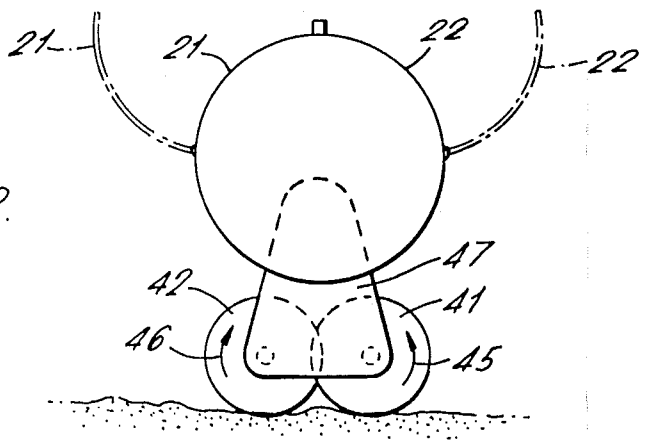

In the embodiment illustrated in FIGS. 1 and 2, a self-propelled underwater-launched weapon 10, for example a torpedo for underwater travel or a guided missile for propulsion in the air above the sea surface, is housed within an elongate outer container 11 which is preferably a water-tight container. The weapon 10 contains propulsion means 12 and preferably contains target sensing means for detecting and homing on a target or a controlled guidance system. The container 11 is of elongate form and generally of cylindrical section and is buried within the sea bed 13 in a substantially horizontal position. The weapon system is laid or dropped onto the sea bed to lie horizontally and is then buried by means of two rotary scroll-type material moving devices 41, 42 extending parallel to one another on the underside of the container 11. These devices are electrically driven by an electric motor or motors 43 powered by batteries 44 within the container 11 and are rotated in opposite directions as indicated by the arrows 45, 46 in FIG. 2 via a drive means 47. Using opposite handed screw-type scrolls, the two devices may be arranged to intermesh, that is to say the spacing between the centres of their shafts is less than the diameter of either of the scrolls. As the directions of rotation are such that the intermeshing parts move downwardly under the centre of the container and then move outwardly, they tend to carry material away from underneath the container and throw it out sideways. The required depth of burial of a horizontal container is much less than for a vertical container, as the depth of burial need only be sufficient to prevent detection by underwater search equipment searching for devices on the sea bed.

Means 48 are provided to initiate operation of the devices 41, 42 after the system has reached the bottom of the sea. This may be done by sensing means, sensing when the device has reached the sea bed or remote control means may be provided actuated by a signal from the craft laying or dropping the weapon system. The weapon system, with its container, is so constructed that, when released in water, it falls in a horizontal orientation with the devices 41, 42 on the underside. Pump means 16 within the container may be provided for supplying a jet or jets **16*a* of water to assist in forcing sand or silt or the like on the sea bed away from the container as the devices 41, 42 displace material from underneath the container 11. The container is thus buried in a substantially horizontal position in the sea bed. Normally the container will be substantially wholly buried to minimise the risk of detection of the weapon system by underwater search equipment. The devices 41, 42** enable the container to be buried in relatively hard materials, such as shingle or compacted silt. After burial, sand or silt may get washed over the container by the sea with the result that the container may be completely covered even although initially it is only partially buried.

Control of the burial operation may be effected automatically, for example using a sensor to detect when the device reaches the sea bed which sensor initiates operation of the burying means and automatically stops rotation of the devices 41, 42 after a predetermined time or after further sensing means have sensed that the device is sufficiently deep into the sea bed.

In the arrangement of FIGS. 1 and 2, ejection of the weapon 10, which is housed within an inner container 20, is effected by opening the upper part of the outer container 11 along its length as shown by the dashed lines 21, 22 in FIG. 2 and then forcing the inner container 20 upwardly, either along its whole length or at one end thereof, for example using a hydraulic ram 18 so that the inner container is raised, at least at one end, above the sea bed.

The weapon 10 is located within the inner container 20 in a piston form housing **20*a* extending part way along the container and closed by an end wall 20*b* within the inner container. When the weapon system is to be actuated, this inner housing is ejected or partially ejected from the outer container by gas from a pressurised gas container 23 acting on an end wall 10*b* to break away a watertight seal 28 across one end of inner container 20. Instead of using a pressurised gas container, gas may be generated, for example, chemically by mixing of suitable chemical reactants or by an explosive charge. The weapon is then ejected through one end of the inner container 20. Ejection is initiated by means of a control system indicated diagrammatically at 24 with communication equipment indicated at 25 arranged for receiving signals, e.g. acoustic signals, but possibly low frequency radio signals, for a distant control station. The communication system may be a two-way communication system if the weapon system contains a sensor 26 or sensors for obtaining information about potential targets for transmission to the control station. In some cases the weapon system may be completely self-contained. In this case the sensor 26**, which might be an acoustic listening device, may be arranged to detect potential targets and to initiate operation of the control system to actuate the weapon system on reception of signals of predetermined nature.

Ejection of the inner container and weapon forces the weapon through any sand or silt over the top of the outer container 11. The propulsive system of the weapon is actuated by the control system so that this will then effect propulsion of the weapon through the water, the weapon thereby leaving the inner container. The inner container may be completely ejected from the outer container 10 or may be only partially ejected, leaving the weapon free to continue onwardly.

Instead of using pressurised gas to eject the inner container, this ejection may be effected using hydrostatic injection, for example using a pump to act on the housing end wall **20*b* of the weapon housing 20*a***.

Although the scroll-type devices 41, 42 have been illustrated as each extending along the whole length of the container, it may be preferred in some cases to have more than two such devices, each being arranged to displace material to one side and beyond the nearer end of the container.

I claim:

1. An underwater weapon system comprising a self-propelled weapon, an elongate container for the weapon, ejection means for expelling the weapon from the container and a rotary material displacing means disposed along the length of the container to form the lower part of the system when the container is disposed horizontally, said material displacing means being arranged for cutting into and displacing material on the sea bed underneath the container.

2. A weapon system as claimed in claim 1 wherein the rotary material displacing means is a rotary scroll means.

3. A weapon system as claimed in claim 1 wherein means are provided for automatically initiating operation of the material displacing means when the container reaches the sea bed.

4. A weapon system as claimed in claim 1 wherein means are provided for automatically stopping operation of the rotary material displacing means after a predetermined time or after the container has entered a sufficient distance into the sea bed.

5. A weapon system as claimed in claim 1 wherein pump means or water jet means are provided additionally for displacing fine particulate material such as sand or silt.

6. A weapon system as claimed in claim 1 wherein the weapon is at least partially within an inner container inside said elongate container and wherein said ejection means is arranged to eject the weapon from the inner container.

7. A weapon system as claimed in claim 1 and having target sensing means for actuating a control system mechanism in the container for releasing the weapon.

8. A weapon system as claimed in claim 1 and having control means responsive to a signal or signals from a distant control station for actuating the control system for releasing the weapon.

9. A weapon system as claimed in claim 1 wherein the rotary material displacing means is a rotary screw means.

10. A weapon system as claimed in claim 9 wherein the rotary material displacing means comprise at least one screw device extending along the underside of the container.

11. A weapon system as claimed in claim 10 wherein two screw devices are employed arranged parallel to one another.

12. A weapon system as claimed in claim 11 wherein the two screw devices are arranged to rotate in opposite directions so as to tend to displace the material outwardly to opposite sides of the container.

13. A weapon system as claimed in claim 12 wherein the two screw devices are arranged to intermesh.

14. A weapon system as claimed in claim 13 wherein the two screw devices are arranged to be rotated in directions such that the intermeshing parts move downwardly and then outwardly sideways to force material from the sea bed up towards and beyond the sides of the container.

* * * * *